US011313007B2

(12) United States Patent
Yuga et al.

(10) Patent No.: US 11,313,007 B2
(45) Date of Patent: Apr. 26, 2022

(54) HIGH-STRENGTH SEAMLESS STEEL PIPE FOR OIL COUNTRY TUBULAR GOODS, AND METHOD FOR PRODUCING THE SAME

(71) Applicant: JFE Steel Corporation, Tokyo (JP)

(72) Inventors: Masao Yuga, Tokyo (JP); Mitsuhiro Okatsu, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 318 days.

(21) Appl. No.: 16/333,029

(22) PCT Filed: Sep. 13, 2017

(86) PCT No.: PCT/JP2017/033007
§ 371 (c)(1),
(2) Date: Mar. 13, 2019

(87) PCT Pub. No.: WO2018/074109
PCT Pub. Date: Apr. 26, 2018

(65) Prior Publication Data

US 2019/0226039 A1 Jul. 25, 2019

(30) Foreign Application Priority Data

Oct. 17, 2016 (JP) ..... JP2016-203347

(51) Int. Cl.

| | |
|---|---|
| ***C21D 6/02*** | (2006.01) |
| ***C21D 8/10*** | (2006.01) |
| ***C21D 9/08*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/32*** | (2006.01) |
| ***C22C 38/44*** | (2006.01) |
| ***C22C 38/46*** | (2006.01) |
| ***C22C 38/48*** | (2006.01) |
| ***C22C 38/54*** | (2006.01) |
| ***C22C 38/20*** | (2006.01) |
| ***C22C 38/28*** | (2006.01) |
| ***C22C 38/42*** | (2006.01) |
| ***C22C 38/50*** | (2006.01) |

(52) U.S. Cl.

CPC ..... *C21D 8/105* (2013.01); *C21D 9/085* (2013.01); *C22C 38/001* (2013.01); *C22C 38/002* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C21D 2211/004* (2013.01); *C21D 2211/008* (2013.01)

(58) Field of Classification Search

CPC .. C21D 2211/008; C21D 6/002; C21D 6/005; C21D 6/008; C21D 6/02; C21D 9/08; C21D 9/085; E21B 17/00

USPC ..... 148/593

See application file for complete search history.

(56) References Cited

U.S. PATENT DOCUMENTS

| | | | | |
|---|---|---|---|---|
| 6,267,828 | B1 | 7/2001 | Kushida et al. | |
| 7,083,686 | B2 | 8/2006 | Itou | |
| 7,670,547 | B2 | 3/2010 | Kobayashi et al. | |
| 7,862,667 | B2 | 1/2011 | Turconi et al. | |
| 8,617,462 | B2 | 12/2013 | Omura | |
| 10,472,690 | B2 | 11/2019 | Yuga et al. | |
| 10,640,856 | B2 | 5/2020 | Yuga et al. | |
| 2006/0016520 | A1 | 1/2006 | Numata | |
| 2009/0098403 | A1 | 4/2009 | Omura et al. | |
| 2012/0186704 | A1* | 7/2012 | Eguchi | C22C 38/06 148/500 |
| 2014/0352836 | A1 | 12/2014 | Eguchi et al. | |
| 2016/0160307 | A1 | 6/2016 | Arai et al. | |

(Continued)

FOREIGN PATENT DOCUMENTS

| | | |
|---|---|---|
| EP | 3026139 A1 | 6/2016 |
| EP | 3192890 A1 | 7/2017 |

(Continued)

OTHER PUBLICATIONS

Secondary steelmaking. Treatise on Process Metallurgy. Elsevier, 2014. 301-345. Chapter 1.6. (Year: 2014).*

Non Final Office Action for U.S. Appl. No. 15/527,893, dated May 12, 2020, 11 pages.

Final Office Action for U.S. Appl. No. 16/078,919, dated Feb. 10, 2021, 20 pages.

Non Final Office Action for U.S. Appl. No. 16/078,927, dated May 28, 2020, 36 pages.

(Continued)

*Primary Examiner* — Jie Yang

(74) *Attorney, Agent, or Firm* — RatnerPrestia

(57) ABSTRACT

Provided herein is a high-strength seamless steel pipe containing a particular chemical composition. The volume fraction of tempered martensite is 90% or more in terms of a volume fraction. The number of nitride inclusions with a particle diameter of 4 μm or more is 50 or less per 100 $mm^2$, the number of nitride inclusions with a particle diameter of less than 4 μm is 500 or less per 100 $mm^2$, the number of oxide inclusions with a particle diameter of 4 μm or more is 40 or less per 100 $mm^2$, and the number of oxide inclusions with a particle diameter of less than 4 μm is 400 or less per 100 $mm^2$ in a cross section perpendicular to a rolling direction.

6 Claims, No Drawings

(56) References Cited

U.S. PATENT DOCUMENTS

| | | | |
|---|---|---|---|
| 2016/0184875 | A1 | 6/2016 | Noh et al. |
| 2017/0283918 | A1 | 10/2017 | Yuga et al. |
| 2017/0349963 | A1 | 12/2017 | Yuga et al. |
| 2017/0349964 | A1 | 12/2017 | Yuga et al. |
| 2017/0362674 | A1 | 12/2017 | Kondo et al. |
| 2018/0327881 | A1 | 11/2018 | Yuga et al. |
| 2019/0048443 | A1 | 2/2019 | Okatsu et al. |
| 2019/0048444 | A1 | 2/2019 | Okatsu et al. |

FOREIGN PATENT DOCUMENTS

| | | | |
|---|---|---|---|
| JP | 2000178682 | A | 6/2000 |
| JP | 2000297344 | A | 10/2000 |
| JP | 2001172739 | A | 6/2001 |
| JP | 2007016291 | A | 1/2007 |
| JP | 2008056991 | A | 3/2008 |
| JP | 2014012890 | A | 1/2014 |
| JP | 5930140 | B1 | 6/2016 |
| WO | 2015011917 | A1 | 1/2015 |
| WO | 2016038809 | A1 | 3/2016 |
| WO | 2016038810 | A1 | 3/2016 |
| WO | 2016079908 | A1 | 5/2016 |
| WO | 2016093161 | A1 | 6/2016 |
| WO | 2016103537 | A1 | 6/2016 |
| WO | 2016103538 | A1 | 6/2016 |

OTHER PUBLICATIONS

Final Office Action for U.S. Appl. No. 15/537,669, dated Apr. 30, 2020, 18 pages.

Final Office Action for U.S. Appl. No. 16/078,927, dated Sep. 11, 2020, 19 pages.

Final Office Action for U.S. Appl. No. 15/527,893, dated Aug. 19, 2020, 7 pages.

Final Office Action for U.S. Appl. No. 15/527,893, dated Jan. 6, 2020, 21 pages.

Non Final Office Action for U.S. Appl. No. 15/527,893, dated Jun. 24, 2019, 28 pages.

Non Final Office Action for U.S. Appl. No. 15/537,669, dated Oct. 30, 2019, 12 pages.

Non Final Office Action for U.S. Appl. No. 15/537,703, dated Oct. 30, 2019, 11 pages.

Final Office Action for U.S. Appl. No. 15/509,350, dated Sep. 5, 2019, 20 pages.

Extended European Search Report for European Application No. 17863132.1, dated Jul. 18, 2019, 8 pages.

International Search Report and Written Opinion for International Application No. PCT/JP2017/033007, dated Dec. 19, 2017—6 pages.

Final Office Action for U.S. Appl. No. 16/078,924, dated Apr. 15, 2021, 29 pages.

Non Final Office Action for U.S. Appl. No. 16/078,919, dated Jul. 10, 2020, 51 pages.

Non Final Office Action for U.S. Appl. No. 16/078,924, dated Jul. 24, 2020, 49 pages.

Non Final Office Action for U.S. Appl. No. 16/064,086, dated Jun. 10, 2020, 35 pages.

Final Office Action for U.S. Appl. No. 15/537,703, dated Apr. 30, 2020, 6 pages.

* cited by examiner

HIGH-STRENGTH SEAMLESS STEEL PIPE FOR OIL COUNTRY TUBULAR GOODS, AND METHOD FOR PRODUCING THE SAME

CROSS REFERENCE TO RELATED APPLICATIONS

This is the U.S. National Phase application of PCT/JP2017/033007, filed Sep. 13, 2017, which claims priority to Japanese Patent Application No. 2016-203347, filed Oct. 17, 2016, the disclosures of these applications being incorporated herein by reference in their entireties for all purposes.

FIELD OF THE INVENTION

The present invention relates to a high-strength seamless steel pipe suitable for oil country tubular goods, and line pipes, and relates particularly to improvement of sulfide stress corrosion cracking resistance (SSC resistance; also called SSCC resistance in short)) in a wet hydrogen sulfide environment (sour environment).

BACKGROUND OF THE INVENTION

For stable supply of energy resources, there has been development of oil fields and natural gas fields in a deep and severe corrosive environment. This has created a strong demand for oil country tubular goods and line pipes for transportation of petroleum and natural gas. That can show desirable SSC resistance in a hydrogen sulfide ($H_2S$)-containing sour environment while maintaining high strength with a yield stress YS of 125 ksi (862 MPa) or more.

Recognizing such needs, for example, PTL 1 proposes a method for producing a steel for oil country tubular goods in which a low-alloy-content steel containing adjusted amounts of C, Cr, Mo, V, specifically, C: 0.2 to 0.35%, Cr: 0.2 to 0.7%, Mo: 0.1 to 0.5%, and V: 0.1 to 0.3% by weight, is quenched from a temperature equal to or greater than the $Ac_3$ transformation point, and tempered at a temperature of 650° C. or more and no greater than the Act transformation point. The technique of PTL 1 is described as being capable of adjusting the total amount of the precipitated carbides to 2 to 5 weight %, and the MC carbide fraction to 8 to 40 weight % of the total amount of the carbides, and thus providing a steel for oil country tubular goods having desirable sulfide stress corrosion cracking resistance.

PTL 2 proposes a method for producing a steel for oil country tubular goods having desirable toughness and desirable sulfide stress corrosion cracking resistance. In this method, a low-alloy steel containing, in mass %, C: 0.15 to 0.3%, Cr: 0.2 to 1.5%, Mo: 0.1 to 1%, V: 0.05 to 0.3%, and Nb: 0.003 to 0.1% is heated to 1,150° C. or higher temperature, and, after finishing hot working at a temperature of 1,000° C. or more, quenched from a temperature of 900° C. or more. The steel is then subjected to at least one quenching and tempering process consisting of tempering at a temperature of 550° C. or more and no greater than the $Ac_1$ transformation point, quenching after reheating the steel to 850 to 1,000° C., and tempering at a temperature of 650° C. or more and no greater than the $Ac_1$ transformation point. The technique of PTL 2 is described as being capable of adjusting the total amount of the precipitated carbides to 1.5 to 4 mass %, the MC carbide fraction to 5 to 45 mass %, and the $M_{23}C_6$ carbide fraction to 200/t (t: wall thickness (mm)) mass % or less of the total amount of the carbides, and providing a steel for oil country tubular goods having desirable toughness and desirable sulfide stress corrosion cracking resistance.

PTL 3 proposes a steel material for oil country tubular goods that contains, in mass %, C: 0.15 to 0.30%, Si: 0.05 to 1.0%, Mn: 0.10 to 1.0%, P: 0.025% or less, S: 0.005% or less, Cr: 0.1 to 1.5%, Mo: 0.1 to 1.0%, Al: 0.003 to 0.08%, N: 0.008% or less, B: 0.0005 to 0.010%, Ca+O: 0.008% or less, and at least one of Ti: 0.005 to 0.05%, Nb: 0.05% or less, Zr: 0.05% or less, and V: 0.30% or less, and in which the maximum length of successive nonmetallic inclusions is 80 μm or less, and the number of nonmetallic inclusions with a particle diameter of 20 μm or more is 10 or less per 100 $mm^2$ of a cross section observed under a microscope. The technique is described as being capable of providing a low-alloy steel material for oil country tubular goods that is strong enough for oil country tubular goods applications, and that has the desirable level of SSC resistance appropriate for the steel strength.

PTL 4 proposes a low-alloy steel for oil country tubular goods containing, in mass %, C: 0.20 to 0.35%, Si: 0.05 to 0.5%, Mn: 0.05 to 0.6%, P: 0.025% or less, S: 0.01% or less, Al: 0.005 to 0.100%, Mo: 0.8 to 3.0%, V: 0.05 to 0.25%, B: 0.0001 to 0.005%, N: 0.01% or less, and O: 0.01% or less, and having desirable sulfide stress corrosion cracking resistance that satisfies $12V+1-Mo \geq 0$. It is stated in the technique described in PTL 4 that the composition may further contain 0.6% or less of chromium so as to satisfy $Mo-(Cr+Mn) \geq 0$, and that the composition may further contain at least one of Nb: 0.1% or less, Ti: 0.1% or less, and Zr: 0.1% or less, or may contain 0.01% or less of calcium.

PTL 5 proposes a high-strength seamless steel pipe for oil country tubular goods of a composition containing, in mass %, C: 0.20 to 0.50%, Si: 0.05 to 0.40%, Mn: 0.3 to 0.9%, P: 0.015% or less, S: 0.005% or less, Al: 0.005 to 0.1%, N: 0.006% or less, Cr: more than 0.6% and 1.7% or less, Mo: more than 1.0% and 3.0% or less, V: 0.02 to 0.3%, Nb: 0.001 to 0.02%, B,: 0.0003 to 0.0030%, O (oxygen): 0.0030% or less, Ti: 0.003 to 0.025%, adjusted amounts of Ti and N satisfying Ti/N: 2.0 to 5.0, and the balance being Fe and unavoidable impurities. The steel pipe has a structure in which the volume fraction of tempered martensite is 95% or more, and the grain size number of prior austenite grains is 8.5 or more, and in which the number of nitride inclusions with a particle diameter of 4 μm or more is 100 or less per 100 $mm^2$, the number of nitride inclusions with a particle diameter of less than 4 μm is 1,000 or less per 100 $mm^2$, the number of oxide inclusions with a particle diameter of 4 μm or more is 40 or less per 100 $mm^2$, and the number of oxide inclusions with a particle diameter of less than 4 μm is 400 or less per 100 $mm^2$ as measured in a cross section perpendicular to the rolling direction. The steel pipe has a yield stress YS of 862 MPa or more.

PATENT LITERATURE

Patent Literature 1: JP-A-2000-178682
Patent Literature 2: JP-A-2000-297344
Patent Literature 3: JP-A-2001-172739
Patent Literature 4: JP-A-2007-16291
Patent Literature 5: Japanese Patent No. 5930140 (WO2016/079908)

SUMMARY OF THE INVENTION

However, because sulfide stress corrosion cracking resistance (SSC resistance) involves a number of factors, the techniques of PTL 1 to PTL 4 alone cannot be said as being sufficient for improving the SSC resistance of a high-strength seamless steel pipe with a yield stress of 125 ksi or more to the level sufficient for oil country tubular goods used in a severe corrosive environment. Another problem is the serious production difficulty in stably adjusting the type and the amount of carbides as described in PTL 1 and PTL 2, and the shape and the number of nonmetallic inclusions as described in PTL 3 within the desired ranges. Considering today's stricter standards used in some occasions for evaluation of SSC resistance, the technique described in PTL 5 needs further improvements.

Accordingly, an object according to aspects of the present invention is to provide a high-strength seamless steel pipe for oil country tubular goods, having excellent sulfide stress corrosion cracking resistance, and a method for producing such a high-strength seamless steel pipe through solution to the problems of the related art.

As used herein, "high-strength" means a yield stress YS of 125 ksi (862 MPa) or more. As used herein, "excellent sulfide stress corrosion cracking resistance" means that a test material subjected to a constant load test according to the test method specified in NACE TM0177, Method A in a 5.0 mass % salt-containing aqueous solution of acetic acid and sodium acetate saturated with 10 kPa hydrogen sulfide and having an adjusted pH of 3.5 (liquid temperature: 24° C.) does not crack even after 720 hours under an applied stress equal to 90% of the yield stress of the test material.

Acknowledging that the desired high strength and excellent SSC resistance need to be satisfied at the same time to achieve the foregoing object, the present inventors conducted an in-depth investigation of various factors that might affect strength and SSC resistance. As a result of the investigation, the present inventors have found that nitride inclusions and oxide inclusions have a large effect on SSC resistance in a high-strength steel pipe having a yield stress YS of 125 ksi or more, though the extent of the effect varies with the size of these inclusions. Among the findings is that nitride inclusions having a particle diameter of 4 μm or more, and oxide inclusions having a particle diameter of 4 μm or more become initiation points of sulfide stress corrosion cracking (SSC), and that SSC becomes more likely to occur as the size of these inclusions increases. It was also found that nitride inclusions having a particle diameter of less than 4 μm do not become an initiation point of SSC when present by themselves, but have an adverse effect on SSC resistance when present in large numbers, and that oxide inclusions of less than 4 μm also have an adverse effect on SSC resistance when present in large numbers.

From these findings, the present inventors envisaged that, in order to further improve SSC resistance, the number of nitride inclusions and oxide inclusions needs to be made smaller than appropriate numbers according to their sizes respectively. In order to make the numbers of nitride inclusions and oxide inclusions smaller than appropriate numbers, it is important to control the N content and the O content within the desired ranges during the production of steel pipe material, particularly during production of molten steel, casting and the like. It is also important to control the production conditions for the steel refining process and the continuous casting process.

The steel pipe described in PTL 5 is made of a Ti-containing steel, which generates large amounts of titanium nitrides, and the present inventors have found that generation of nitrides, which is a factor that affects SSC resistance, can be suppressed to only limited extents in this case, and that this might interfere with further improvement of SSC resistance. In addition to deteriorating SSC resistance, nitrides and carbides of titanium may also deteriorate toughness when coarsen. The present inventors have also found that that pinning effect of TiN, described in PTL 5 as making finer crystal grains, becomes weak under the heat treatment conditions used therein. After further studies, the present inventors found that the desired characteristics can be achieved by making the Ti content less than 0.003% when adopting today's stricter standards used for evaluation of SSC resistance.

Aspects of the present invention were completed on the basis of these findings and with further studies, and are summarized as follows.

(1) A high-strength seamless steel pipe for oil country tubular goods, the high-strength seamless steel pipe having a composition that comprises, in mass %, C: 0.20 to 0.50%, Si: 0.05 to 0.40%, Mn: 0.3 to 0.9%, P: 0.015% or less, S: 0.005% or less, Al: 0.03 to 0.1%, N: 0.006% or less, Cr: more than 0.6% and 1.7% or less, Mo: more than 1.0% and 3.0% or less, V: 0.02 to 0.3%, Nb: 0.001 to 0.02%, B: 0.0005 to 0.0040%, O (oxygen): 0.0030% or less, Ti: less than 0.003%, and the balance being Fe and unavoidable impurities;

the high-strength seamless steel pipe having a structure in which the volume fraction of tempered martensite is 90% or more, and in which the number of nitride inclusions with a particle diameter of 4 μm or more is 50 or less per 100 $mm^2$, the number of nitride inclusions with a particle diameter of less than 4 μm is 500 or less per 100 $mm^2$, the number of oxide inclusions with a particle diameter of 4 μm or more is 40 or less per 100 $mm^2$, and the number of oxide inclusions with a particle diameter of less than 4 μm is 400 or less per 100 $mm^2$ in a cross section perpendicular to a rolling direction; and the high-strength seamless steel pipe having a yield stress YS of 862 MPa or more.

(2) The high-strength seamless steel pipe for oil country tubular goods according to item (1), wherein the structure contains at most 100 carbides having a corresponding circle diameter of 175 nm or more per 100 $\mu m^2$ in a cross section perpendicular to the rolling direction.

(3) The high-strength seamless steel pipe for oil country tubular goods according to item (1) or (2), wherein the composition further contains, in mass %, at least one selected from Cu: 1.0% or less, Ni: 1.0% or less, and W: 3.0% or less.

(4) The high-strength seamless steel pipe for oil country tubular goods according to any one of items (1) to (3), wherein the composition further contains, in mass %, Ca: 0.0005 to 0.0050%.

(5) A method for producing a seamless steel pipe for oil country tubular goods by heating a steel pipe material, and hot working the steel pipe material into a seamless steel pipe of a predetermined shape, wherein the method is for producing the high-strength seamless steel pipe for oil country tubular goods of any one of items (1) to (4), and comprises:

heating the steel pipe material in a heating temperature range of 1,050 to 1,350° C.;

cooling the hot-worked seamless steel pipe to a surface temperature of 200° C. or less at a cooling rate of air cooling or faster; and tempering the seamless steel pipe by heating to a temperature of 640 to 740° C.

(6) The method according to claim 5, wherein the seamless steel pipe after the cooling and before the tempering is quenched at least once by being reheated to a temperature equal to or greater than the $Ac_3$ transformation point and 1,000° C. or less, and rapidly cooled to a surface temperature of 200° C. or less.

Aspects of the present invention can provide a high-strength seamless steel pipe for oil country tubular goods, having high strength with a yield stress YS of 125 ksi (862 MPa) or more, and excellent sulfide stress corrosion cracking resistance. By containing appropriate amounts of appropriate alloy elements, and by suppressing generation of nitride inclusions and oxide inclusions, aspects of the present invention enable stable production of a high-strength seamless steel pipe that has excellent SSC resistance while maintaining the desired high strength for oil country tubular goods applications.

DETAILED DESCRIPTION OF EMBODIMENTS OF THE INVENTION

A high-strength seamless steel pipe for oil country tubular goods according to aspects of the present invention (hereinafter, also referred to simply as "high-strength seamless steel pipe") has a composition that contains, in mass %, C: 0.20 to 0.50%, Si: 0.05 to 0.40%, Mn: 0.3 to 0.9%, P: 0.015% or less, S: 0.005% or less, Al: 0.03 to 0.1%, N: 0.006% or less, Cr: more than 0.6% and 1.7% or less, Mo: more than 1.0% and 3.0% or less, V: 0.02 to 0.3%, Nb: 0.001 to 0.02%, B: 0.0005 to 0.0040%, O (oxygen): 0.0030% or less, Ti: less than 0.003%, and the balance being Fe and unavoidable impurities;

the high-strength seamless steel pipe having a structure in which the volume fraction of tempered martensite is 90% or more, and in which the number of nitride inclusions with a particle diameter of 4 μm or more is 50 or less per 100 $mm^2$, the number of nitride inclusions with a particle diameter of less than 4 μm is 500 or less per 100 $mm^2$, the number of oxide inclusions with a particle diameter of 4 μm or more is 40 or less per 100 $mm^2$, and the number of oxide inclusions with a particle diameter of less than 4 μm is 400 or less per 100 $mm^2$ in a cross section perpendicular to a rolling direction; and, the high-strength seamless steel pipe having a yield stress YS of 862 MPa or more.

The reasons for specifying the composition of the high-strength seamless steel pipe according to aspects of the present invention are described below. In the following, "%" used in conjunction with the composition means percent by mass.

C: 0.20 to 0.50%

Carbon forms a solid solution, and contributes to enhancing steel strength. This element also contributes to improving the hardenability of the steel, and forming a structure with a primary martensite phase during quenching. Carbon needs to be contained in an amount of 0.20% or more to obtain this effect. A carbon content of more than 0.50% generates cracks during quenching, and seriously deteriorates productivity. For this reason, the C content is in a range of 0.20 to 0.50%. Preferably, the C content is 0.20 to 0.35%, more preferably 0.22 to 0.32%.

Si: 0.05 to 0.40%

Silicon is an element that acts as a deoxidizing agent. This element enhances steel strength by forming a solid solution in the steel, and suppresses softening during tempering. Silicon needs to be contained in an amount of 0.05% or more to obtain this effect. A Si content of more than 0.40% promotes generation of the softening ferrite phase, and makes it difficult to improve strength as desired. Silicon in this content range also promotes formation of coarse oxide inclusions, and deteriorates SSC resistance and toughness. Silicon also causes local hardening of the steel by segregation. That is, when contained in excess of 0.40%, silicon causes an adverse effect by forming local hard regions, and deteriorates SSC resistance. For these reasons, the Si content is in a range of 0.05 to 0.40% in accordance with aspects of the present invention. Preferably, the Si content is 0.05 to 0.30%, more preferably 0.20 to 0.30%.

Mn: 0.3 to 0.9%

As is carbon, manganese is an element that improves hardenability of the steel, and that contributes to enhancing steel strength. Manganese needs to be contained in an amount of 0.3% or more to obtain this effect. However, this element causes local hardening of the steel by segregation. When contained in excess of 0.9%, manganese causes an adverse effect by forming local hard regions, and deteriorates SSC resistance. For this reason, the Mn content is in a range of 0.3 to 0.9% in accordance with aspects of the present invention. Preferably, the Mn content is 0.4 to 0.8%, more preferably 0.5 to 0.8%.

P: 0.015% or Less

Phosphorus segregates at grain boundaries, and causes embrittlement in grain boundaries. This element also causes local hardening of the steel by undergoing segregation. In accordance with aspects of the present invention, it is preferable to contain phosphorus as unavoidable impurities in as small an amount as possible. However, a P content of at most 0.015% is acceptable. For this reason, the P content is 0.015% or less, preferably 0.012% or less.

S: 0.005% or Less

Sulfur is contained as unavoidable impurities, and is present almost entirely as sulfide inclusions in the steel. Because sulfur deteriorates ductility, toughness, and SSC resistance, the S content should be reduced as much as possible. However, a sulfur content of at most 0.005% is acceptable. For this reason, the S content is 0.005% or less, preferably 0.003% or less, further preferably 0.0015% or less.

Al: 0.03 to 0.1%

Aluminum acts as a deoxidizing agent, and forms AlN by binding to nitrogen. Aluminum thus contributes to producing fine austenite grains during heating. Aluminum also fixes nitrogen, and prevents the solid solute boron from binding to nitrogen. This prevents the hardenability improving effect of boron from becoming weaker. Aluminum is also an element that does not easily dissolve in cementite, and formation of a coarse cementite can be suppressed by reducing cementite generation from the Al-containing austenite. Cementite is a kind of carbide that easily coarsens, and reducing the number of coarse cementites results in fewer numbers of coarse carbides being produced. Aluminum needs to be contained in an amount of 0.03% or more to obtain this effect. In order to obtain the foregoing effect, it is particularly important to make the Al content 0.03% or more in the steel pipe according to aspects of the present invention in which the Ti content is limited to less than 0.003%. An Al content of more than 0.1% increases the oxide inclusions, and reduces the cleanness of the steel, with the result that the ductility, toughness, and SSC resistance deteriorate. For this reason, the Al content is in a range of 0.03 to 0.1%. Preferably, the Al content is 0.04 to 0.09%, more preferably 0.05 to 0.08%. As used herein, "carbide" refers to a compound formed by carbon (C) and other metallic elements. As used herein, "cementite", which is a carbide, refers to a compound formed by iron (Fe) and carbon (C).

N: 0.006% or Less

Nitrogen is present as unavoidable impurities in the steel. Nitrogen forms AlN by binding to aluminum, and forms TiN when Ti is contained. Thus, nitrogen makes finer crystal grains and improves toughness. However, a N content of more than 0.006% causes formation of coarse nitrides, and seriously deteriorates SSC resistance and toughness. For this reason, the N content is 0.006% or less.

Cr: More than 0.6% and 1.7% or Less

Chromium is an element that enhances steel strength by improving hardenability, and that improves corrosion resistance. Chromium binds to carbon during tempering, and forms carbides such as $M_3C$, $M_7C_3$, and $M_{23}C_6$ (where M is a metallic element), and improves tempering softening resistance. This makes chromium an essential element, particularly for achieving high strength in a steel pipe. The $M_3C$ carbide is particularly effective at improving tempering softening resistance. In order to obtain these effects, chromium needs to be contained in an amount of more than 0.6%. When contained in excess of 1.7%, chromium forms large amounts of carbides such as $M_7C_3$, and $M_{23}C_6$, and deteriorates SSC resistance by acting as a hydrogen trapping site. For these reasons, the Cr content is in a range of more than 0.6% and 1.7% or less. Preferably, the Cr content is 0.8 to 1.5%, more preferably 0.8 to 1.3%.

Mo: More than 1.0% and 3.0% or Less

Molybdenum is an element that forms a carbide, and contributes to strengthening the steel through precipitation strengthening. Thus, molybdenum effectively contributes to providing the desired high strength while the tempering reduces dislocation density. A reduced dislocation density improves SSC resistance. Molybdenum also forms a solid solution in the steel, and segregates at prior austenite grain boundaries, and contributes to improving SSC resistance. Molybdenum also acts to density the corrosion product, and suppress generation and growth of pits, which become an initiation point of cracking. Molybdenum needs to be contained in an amount of more than 1.0% to obtain these effects. A Mo content of more than 3.0% promotes formation of a needle-like $M_2C$ precipitate (carbide), or, in some cases, the Laves phase ($Fe_2Mo$), and deteriorates the SSC resistance. For this reason, the Mo content is in a range of more than 1.0% and 3.0% or less. Preferably, the Mo content is more than 1.1% and 3.0% or less, more preferably more than 1.2% and 2.8% or less, further preferably 1.45 to 2.5%, even more preferably 1.45 to 1.80%.

V: 0.02 to 0.3%

Vanadium is an element that forms carbides and carbonitrides, and contributes to strengthening the steel. Vanadium needs to be contained in an amount of 0.02% or more to obtain this effect. When vanadium is contained in excess of 0.3%, the effect becomes saturated, and the increased content does not produce an additional effect corresponding to the increased content. This is not desirable in terms of economy. For this reason, the V content is 0.02 to 0.3%. Preferably, the V content is in a range of 0.03 to 0.20%, more preferably 0.15% or less.

Nb: 0.001 to 0.02%

Niobium forms carbides, or carbides and carbonitrides, and contributes to enhancing steel strength through precipitation strengthening. Niobium also contributes to producing fine austenite grains. Niobium needs to be contained in an amount of 0.001% or more to obtain these effects. However, a Nb precipitate easily becomes a propagation pathway of SSC (sulfide stress corrosion cracking), and an abundance of Nb precipitates due to an excessive Nb content of more than 0.02% leads to serious deterioration of SSC resistance, particularly in a high-strength steel material having a yield stress of 125 ksi or more. From the standpoint of satisfying both the desired high strength and excellent SSC resistance, the Nb content is 0.001 to 0.02% in accordance with aspects of the present invention. Preferably, the Nb content is 0.001% or more and less than 0.01%.

B: 0.0005 to 0.0040%

Boron segregates at austenite grain boundaries, and suppresses transformation of ferrite from the grain boundaries. In this way, boron acts to improve the hardenability of the steel even when contained in small amounts. Boron needs to be contained in an amount of 0.0005% or more to obtain this effect. When contained in excess of 0.0040%, boron precipitates in the form of, for example, carbonitrides, and deteriorates hardenability, and hence toughness. For this reason, the B content is 0.0005 to 0.0040%. Preferably, the B content is 0.0010 to 0.0030%.

Ti: Less than 0.003%

Titanium strongly binds to nitrogen, and generates inclusions (nitride inclusions) in the steel even when contained in small amounts. This results in poor SSC resistance. Nitride amounts (nitride inclusion amounts) tend to increase, and these inclusions tend to coarsen as the amount of titanium is increased. This also results in poor SSC resistance. For this reason, titanium is not added, and, when contained, the Ti content is less than 0.003%. Preferably, the Ti content is 0.002% or less.

O (Oxygen): 0.0030% or Less

Oxygen is present as unavoidable impurities, specifically, oxide inclusions in the steel. The inclusions become an initiation point of SSC (sulfide stress corrosion cracking), and deteriorate SSC resistance. It is accordingly preferable in accordance with aspects of the present invention to reduce the O (oxygen) content as much as possible. However, an oxygen content of at most 0.0030% is acceptable because excessively reduced oxygen content raises the refining cost. For this reason, the O (oxygen) content is 0.0030% or less. Preferably, the O content is 0.0020% or less.

In addition to the foregoing components, the composition contains the balance Fe and unavoidable impurities. Acceptable as unavoidable impurities are Mg: 0.0008% or less, and Co: 0.05% or less.

The composition containing the foregoing basic components may additionally contain one or more selectable elements selected from Cu: 1.0% or less, Ni: 1.0% or less, and W: 3.0% or less. The composition may also contain Ca: 0.0005 to 0.005%, with or without these selectable elements. One element or more elements of Cu: 1.0% or less, Ni: 1.0% or less, and W: 3.0% or less Copper, nickel, and tungsten all contribute to enhancing steel strength, and one or more of these elements may be contained by being selected, as required.

In addition to enhancing steel strength, copper acts to improve toughness and corrosion resistance. Copper is particularly effective at improving SSC resistance in a severe corrosive environment. When copper is contained, a dense corrosion product is formed, and this improves the corrosion resistance, and suppresses generation and growth of pits, which become an initiation point of cracking. Desirably, copper is contained in an amount of 0.03% or more to obtain such an effect. When the copper is contained in excess of 1.0%, the effect becomes saturated, and the increased content does not produce an additional effect corresponding to the increased content. This is not desirable in terms of economy. For this reason, when copper is contained, the copper content is limited to preferably 1.0% or less.

In addition to enhancing steel strength, nickel improves toughness and corrosion resistance. Desirably, nickel is contained in an amount of 0.03% or more to obtain such an effect. When the nickel is contained in excess of 1.0%, the effect becomes saturated, and the increased content does not produce an additional effect corresponding to the increased content. This is not desirable in terms of economy. For this reason, when nickel is contained, the nickel content is limited to preferably 1.0% or less.

Tungsten forms carbides, and enhances steel strength through precipitation strengthening. Tungsten also forms a solid solution, and contributes to improving SSC resistance by segregating at prior austenite grain boundaries. Desirably, tungsten is contained in an amount of 0.03% or more to obtain such an effect. When the tungsten is contained in excess of 3.0%, the effect becomes saturated, and the increased content does not produce an additional effect corresponding to the increased content. This is not desirable in terms of economy. For this reason, when tungsten is contained, the tungsten content is limited to preferably 3.0% or less.

Ca: 0.0005 to 0.005%

Calcium is an element that forms CaS with sulfur, and effectively controls the morphology of sulfide inclusions. By controlling the morphology of sulfide inclusions, calcium contributes to improving toughness and SSC resistance. Calcium needs to be contained in an amount of 0.0005% or more to obtain such an effect. When the calcium is contained in excess of 0.005%, the effect becomes saturated, and the increased Ca content does not produce an additional effect corresponding to the increased content. This is not desirable in terms of economy. For this reason, when calcium is contained, the calcium content is limited to preferably 0.0005 to 0.005%.

In addition to the composition described above, the high-strength seamless steel pipe according to aspects of the present invention has a structure in which the volume fraction of primary-phase tempered martensite is 90% or more, and in which the number of nitride inclusions with a particle diameter of 4 μm or more is 50 or less per 100 $mm^2$, the number of nitride inclusions with a particle diameter of less than 4 μm is 500 or less per 100 $mm^2$, the number of oxide inclusions with a particle diameter of 4 μm or more is 40 or less per 100 $mm^2$, and the number of oxide inclusions with a particle diameter of less than 4 μm is 400 or less per 100 $mm^2$ in a cross section perpendicular to a rolling direction, Primary Phase: Tempered Martensite Phase The high-strength seamless steel pipe according to aspects of the present invention has a structure that is primarily a martensite phase so that a high strength with a yield stress YS of 125 ksi (862 MPa) or more can be achieved. In order to provide the necessary ductility and toughness for the structure, the martensite phase is tempered to make tempered martensite phase as a primary phase. As used herein, "primary phase" refers to a single phase that is 100% tempered martensite phase by volume fraction, or a phase containing 90% or more of the tempered martensite phase, and at most 10% of a secondary phase, which is an amount that does not affect the characteristics. In accordance with aspects of the present invention, examples of the secondary phase include a bainite phase, a residual austenite phase, perlite, or a mixed phase thereof.

The structure of the high-strength seamless steel pipe according to aspects of the present invention can be adjusted by appropriately selecting the heating temperature of quenching and the cooling rate of cooling, which varies with the steel components.

In the high-strength seamless steel pipe according to aspects of the present invention, the number of nitride inclusions, and the number of oxide inclusions are adjusted within appropriate ranges according to size (particle diameter) to improve SSC resistance. Identification of nitride inclusions and oxide inclusions is made by automatic detection using a scanning electron microscope. Nitride inclusions are identified as inclusions containing Al as a primary component, and oxide inclusions are identified as inclusions containing Al, Ca, and Mg as primary components. The number of inclusions is measured on a surface of a cross section perpendicular to the rolling direction of the steel pipe (a cross section perpendicular to the pipe axis direction; cross section C). The inclusion size is the particle diameter of the inclusions. The particle diameter of an inclusion is determined by calculating the diameter of a corresponding circle of an area determined for an inclusion particle.

Number of Nitride Inclusions with a Particle Diameter of 4 μm or More is 50 or Less per 100 $mm^2$ In a high-strength steel pipe with a yield stress of 125 ksi or more, nitride inclusions become an initiation point of SSC (sulfide stress corrosion cracking), and this adverse effect becomes more prominent as the size (particle diameter) increases to 4 μm or more. It is accordingly desirable to reduce the number of nitride inclusions with a particle diameter of 4 μm or more as much as possible. However, the adverse effect on SSC resistance can be tolerated when the number of nitride inclusions with a particle diameter of 4 μm or more is 50 or less per 100 $mm^2$. For this reason, number of nitride inclusions with a particle diameter of 4 μm or more is limited to 50 or less per 100 $mm^2$. The number is preferably 40 or less.

Number of Nitride Inclusions with a Particle Diameter of Less Than 4 μm is 500 or Less per 100 $mm^2$ Nitride inclusions with a particle diameter of less than 4 μm do not become an initiation point of SSC (sulfide stress corrosion cracking) by themselves. However, when the number of nitride inclusions in this particle diameter range increases above 500 per 100 $mm^2$, their adverse effect on SSC resistance becomes unacceptable in a high-strength steel pipe having a yield stress YS of 125 ksi or more. For this reason, the number of nitride inclusions with a particle diameter of less than 4 μm is limited to 500 or less per 100 $mm^2$. The number is preferably 450 or less.

Number of Oxide Inclusions with a Particle Diameter of 4 μm or More is 40 or Less per 100 $mm^2$ In a high-strength steel pipe with a yield stress of 125 ksi or more, oxide inclusions become an initiation point of SSC (sulfide stress corrosion cracking), and this adverse effect becomes more prominent as the size (particle diameter) increases to 4 μm or more. It is accordingly desirable to reduce the number of oxide inclusions with a particle diameter of 4 μm or more as much as possible. However, the adverse effect on SSC resistance can be tolerated when the number of oxide inclusions with a particle diameter of 4 μm or more is 40 or less per 100 $mm^2$. For this reason, number of oxide inclusions with a particle diameter of 4 μm or more is limited to 40 or less per 100 $mm^2$. The number is preferably 35 or less.

Number of Oxide Inclusions with a Particle Diameter of Less Than 4 μm is 400 or Less per 100 $mm^2$ In a high-strength steel having a yield stress of 125 ksi or more, oxide inclusions become an SSC initiation point even with a small particle diameter of less than 4 μm, and their adverse effect on SSC resistance becomes more prominent as the number increases. It is accordingly desirable to reduce the number of oxide inclusions with a particle diameter of less than 4 μm as much as possible. However, the adverse effect on SSC resistance can be tolerated when the number of oxide inclusions with a particle diameter of less than 4 μm is 400 or less per 100 $mm^2$. For this reason, the number of oxide inclusions with a particle diameter of less than 4 μm is limited to 400 or less per 100 $mm^2$. The number is preferably 365 or less.

In accordance with aspects of the present invention, control of the molten steel refining process is important in adjusting nitride inclusions and oxide inclusions. In a hot metal pretreatment process, desulfurization and dephosphorization are performed, and, after decarburization and dephosphorization with a converter, the steel is subjected to stirred refining under heat (LF), and RH vacuum degassing, using a ladle. Here, a sufficient time is provided for the stirred refining process under heat (LF), and for the RH vacuum degassing, and the RH circulation rate is controlled. When the steel is cast into a cast steel piece (steel pipe material) in continuous casting, inert gas sealing is made for teaming of the steel from the ladle into a tundish, and the steel is electromagnetically stirred in a mold to separate the inclusions by floating, so that the number of nitride inclusions and the number of oxide inclusions may be confined within the foregoing ranges per unit area.

Carbides with a Corresponding Circle Diameter of 175 nm or More: 100 or Less per 100 $\mu m^2$ Cementite is a carbide that easily coarsens. Coarse carbides become a propagation pathway of SSC cracking. Therefore, reducing the number of coarse cementites makes fewer coarse carbides having a corresponding circle diameter of 175 nm or more, which improves the SSC resistance. It is accordingly preferable that the number of carbides having a corresponding circle diameter of 175 nm or more is 100 or less per 100 $\mu m^2$. More preferably, the number of carbides having a corresponding circle diameter of 175 nm or more is 80 or less, further preferably 60 or less per 100 $\mu m^2$.

The number of carbides is measured on a surface of a cross section perpendicular to the rolling direction and containing the wall thickness center of the steel pipe (a cross section perpendicular to the pipe axis direction; cross section C). The carbide size is the diameter of a corresponding circle of carbides. The diameter of a Corresponding circle of carbides is determined by calculating the diameter of a corresponding circle of an area determined for a carbide particle.

The following describes a method for producing the high-strength seamless steel pipe according to aspects of the present invention.

In accordance with aspects of the present invention, the steel pipe material of the foregoing composition is heated, and hot worked into a seamless steel pipe of a predetermined shape.

Preferably, the steel pipe material used in accordance with aspects of the present invention is made as follows. A molten steel of the foregoing composition is produced by using an ordinary steel making method such as by using a converter, and made into a cast steel piece (round cast steel piece) using an ordinary casting method such as continuous casting. The cast steel piece may be hot rolled to make a round steel piece of a predetermined shape, or a round steel piece may be obtained through ingot casting and-bloming.

In accordance with aspects of the high-strength seamless steel pipe of the present invention, nitride inclusions and oxide inclusions are respectively reduced to numbers that do not exceed the foregoing ranges per unit area so that the SSC resistance can further improve. To this end, the nitrogen and oxygen contents in the steel pipe material (a cast steel piece or a rolled steel piece) need to be reduced as much as possible within the N content range of 0.006% or less, and the O content range of 0.0030% or less.

Control of the molten steel refining process is important to bring numbers of nitride inclusions and oxide inclusions to numbers that do not exceed the foregoing ranges per unit area respectively. Preferably, in accordance with aspects of the present invention, desulfurization and dephosphorization are performed in a hot metal pretreatment process, and, after decarburization and dephosphorization with a converter furnace, the steel is subjected to stirred refining under heat (LF), and RH vacuum degassing, using a ladle. The CaO or CaS concentration in the inclusions becomes smaller as the LF time is increased to 30 minutes or longer. This produces $MgO—Al_2O_3$-based inclusions, and improves the SSC resistance. As the RH time is increased to 20 minutes or longer, the oxygen concentration in the molten steel decreases, and the size and the number of oxide inclusions become smaller. It is accordingly preferable that the stirred refining under heat (LF) be performed for at least 30 minutes, and the RH vacuum degassing be performed for at least 20 minutes, and that the RH circulation rate be 85 ton/min or more. The desired numbers of inclusions cannot be obtained when the RH circulation rate is less than 85 ton/min.

When making the cast steel piece (steel pipe material) using continuous casting, it is preferable to make inert gas sealing for teeming from a ladle to a tundish, so that nitride inclusions and oxide inclusions do not exceed the foregoing ranges per unit area. It is also preferable to electromagnetically stir the steel in a mold to separate the inclusions by floating. The amount and the size of nitride inclusions and oxygen inclusions can be adjusted in this fashion.

Thereafter, the cast steel piece (steel pipe material) of the foregoing composition is heated to a temperature of 1,050 to 1,350° C. and then subjected to hot working. This forms a seamless steel pipe of predetermined dimensions.

Heating Temperature: 1,050 to 1,350° C.

The carbides in the steel pipe material cannot sufficiently dissolve when the heating temperature is less than 1,050° C. When the steel pipe material is heated to a temperature higher than 1,350° C., crystal grains coarsen, and precipitates, such as TiN, which have formed upon solidification, also coarsen. Such high heating temperatures also coarsen the cementite, and the toughness of the steel pipe deteriorates. A high heating temperature above 1,350° C. also forms a thick scale layer on the steel pipe material surface. This is not preferable because such a thick scale layer becomes a cause of defects such as a surface scratch during rolling. A high heating temperature above 1,350° C. also involves an increased energy loss, and is not preferable in terms of saving energy. For these reasons, the heating temperature is limited to 1,050 to 1,350° C. The heating temperature is preferably 1,100 to 1,300° C.

The heated steel pipe material is then subjected to hot working (pipe making) using a hot rolling mill such as Mannesmann-plug mill or Mannesmann-mandrel mill to form a seamless steel pipe of predetermined dimensions. The seamless steel pipe may be formed using hot extrusion by pressing.

After the hot working, the seamless steel pipe is subjected to cooling, in which the seamless steel pipe is cooled to a surface temperature of 200° C. or less at a cooling rate of air cooling or faster.

Cooling After Hot Working

Cooling Rate: Air cooling or faster

Cooling Stop Temperature: 200° C. or Less

In the composition range according to aspects of the present invention, the structure having a primary martensite phase can be obtained by cooling the hot-worked steel material (i.e. hot-worked seamless steel pipe of a predetermined shape) at a cooling rate of air cooling or faster. Transformation may not proceed to completion when air cooling (cooling) is stopped while the surface temperature is higher than 200° C. In the cooling after the hot working, the steel material is cooled to a surface temperature of 200° C. or less at a cooling rate of air cooling or faster. As used herein, "cooling rate of air cooling or faster" means a cooling rate of 0.1° C./s or more, and this may be achieved by water cooling. In the case of water cooling, the cooling rate depends on the wall thickness of the steel pipe, and the water cooling method. With a cooling rate of less than 0.1° C./s, the metal structure becomes heterogeneous after the cooling, and the subsequent heat treatment produces a heterogeneous metal structure.

The cooling at a cooling rate of air cooling or faster is followed by tempering. The tempering is a process that involves heating in a temperature range of 640 to 740° C.

Tempering Temperature: 640 to 740° C.

The tempering is performed to reduce the dislocation density, and to improve toughness and SSC resistance. A tempering temperature of less than 640° C. is not sufficient for reducing dislocation, and therefore cannot provide desirable SSC resistance. With a tempering temperature of more than 740° C., the structure overly softens, and the desired high strength cannot be obtained. For this reason, the tempering temperature is limited to in a temperature range of 640 to 740° C. The tempering temperature is preferably 660 to 710° C.

In order to stably provide the desired characteristics, it is preferable that the hot-worked steel material is cooled at a cooling rate of air cooling or faster, then subjected to quenching at least once including reheating and rapid cooling such as water cooling, and then subjected to tempering.

Reheating Temperature for Quenching: Temperature Equal to or Greater than $Ac_3$ Transformation Point and 1,000° C. or Less When the reheating temperature is less than the $Ac_3$ transformation point, the steel material cannot be heated to in the single austenite phase region, and a sufficient structure with a primary martensite phase cannot be obtained. With a reheating temperature of more than 1,000° C., there is an adverse effect such that crystal grains coarsen, and the toughness deteriorates. In addition, such high reheating temperatures also make the surface oxidation scale thicker, and these oxidation scales easily exfoliate, and cause a surface scratch on a steel sheet. A reheating temperature higher than 1,000° C. also puts an excessive load on the heat treatment furnace, and this is problematic in terms of saving energy. For these reasons, and from the standpoint of energy conservation, the reheating temperature for quenching is limited to a temperature that is equal to or greater than the $Ac_3$ transformation point and 1,000° C. or less. The reheating temperature is preferably 950° C. or less.

Further, in the rapid cooling for quenching, quenching being performed after reheating, the steel is cooled steel to a surface temperature of 200° C. or less, preferably 100° C. or less, by water cooling that cools the steel at an average cooling rate of 2° C./s or more to preferably 400° C. or less as measured at the wall thickness center. The quenching may be repeated two or more times.

The $Ac_3$ transformation point is a value calculated according to the following formula.

$$Ac_3 \text{ transformation point } (^\circ\text{ C.}) = 937 - 476.5C + 56Si - 19.7Mn - 16.3Cu - 4.9Cr - 26.6Ni + 38.1Mo + 124.8V + 136.3Ti + 198Al + 3315B$$

In the formula, C, Mn, Cu, Cr, Ni, Mo, V, Ti, Al, and B represent the content of each element in mass %.

In the calculation of the $Ac_3$ transformation point, the content is regarded as zero percent for elements that are not contained.

The quenching and the tempering may be followed by a corrective process that corrects defects of the shape of the steel pipe by warming or cooling, as required.

EXAMPLES

The present invention is further described below through Examples.

The hot metal tapped off from a blast furnace was desulfurized and dephosphorized in a hot metal pretreatment process, and subsequently decarburized and dephosphorized with a converter, and then subjected to stirred refining under heat (LF) for 60 minutes, and 10 to 40 minutes of RH vacuum degassing at a circulation rate of 120 ton/min, as shown in Table 2, to produce molten steels of the compositions shown in Table 1. The molten steel was then cast into a cast steel piece by continuous casting (round cast steel piece: a diameter ϕ of 190 mm). The continuous casting was performed with an Ar gas shield for the tundish, and electromagnetic stirring in the mold.

The cast steel piece, or a steel pipe material, was charged into a heating furnace, heated to the temperatures shown in Table 2, and maintained (holding time: 2 h). The heated steel pipe material was hot worked using a Mannesmann-plug mill as hot rolling mill to produce a seamless steel pipe (measuring 100 to 200 mm ϕ in outer diameter, and 12 to 30 mm in wall thickness). After the hot working, the seamless steel pipe was air cooled, and subjected to quenching and tempering under the conditions shown in Table 2. Some of the samples were water cooled after hot working, and subjected to tempering, or quenching and tempering.

Test pieces were collected from the seamless steel pipes obtained, and subjected to structure observation, tensile test, and sulfide stress corrosion cracking test. The tests were conducted in the manner described below.

(1) Structure Observation

A test piece for structure observation was collected from the seamless steel pipe from a ¼-thickness location from the inner side of the pipe, and a cross section (cross section C) orthogonal to the longitudinal direction of the pipe was polished, and etched to reveal the structure (nital: a nitric acid-ethanol mixture). The structure was observed with a light microscope (magnification: 1,000 times) and a scanning electron microscope (magnification: 2,000 to 3,000 times), and the image was captured in four or more fields. By analyzing the image of the observed structure, the constituting phases of the structure were identified, and the fractions of these phases were calculated.

The structure of the test piece for structure observation was also observed in a 400 $mm^2$ region using a scanning electron microscope (magnification: 2,000 to 3,000 times). The inclusions were automatically detected from the tone difference of the image. Simultaneously, the type, the size, and the number of inclusions were found by an automatic quantitative analysis performed with an EDX equipped with the scanning microscope. The inclusion type was determined by EDX (energy dispersive X-ray) quantitative analysis. The inclusions were categorized as nitride inclusions when the primary components were Ti and Nb, and oxide inclusions when the primary components were Al, Ca, and Mg. As used herein, "primary components" means that the elements make up 65 mass % or more of the inclusions in total.

The number of particles identified as inclusions was determined, and the area of each grain was calculated. The diameter of a corresponding circle was then determined as the particle diameter of the inclusions. The number density (number/100 $mm^2$) was calculated for inclusions having a particle diameter of 4 μm or more, and for inclusions having a particle diameter of less than 4 μm. Inclusions with a longer side being shorter than 2 μm were not analyzed.

The number of carbides was determined from a test piece for structure observation collected from the seamless steel pipe at a location that contained the center of the wall thickness. A cross section perpendicular to the rolling direction (cross section orthogonal to the longitudinal direction of the pipe; cross section C) was polished, and etched with vital to reveal the structure. The structure was then observed with a scanning electron microscope (magnification: 13,000 times). Images were taken in ten arbitrarily chosen fields, and a total of 550 $\mu m^2$-area was observed. The corresponding circle diameter of carbide was determined from the observed structure image, using image processing software.

(2) Tensile Test

For the tensile test, a JIS 10 tensile test piece (rod-like test piece: diameter of a parallel portion: 12.5 mmφ; length of a parallel portion: 60 mm; GL: 50 mm) was collected from the seamless steel pipe at a ¼-thickness location from the inner side of the pipe according to the JIS Z 2241 specifications. Here, the test piece was collected in such an orientation that the pipe axis was in the tensile direction. In the test, the tensile characteristics (yield stress YS (0.5% proof stress), and tensile stress TS) were determined.

(3) Sulfide Stress Corrosion Cracking Test

A tensile test piece (diameter of a parallel portion: 6.35 mm φ×length of a parallel portion: 25.4 mm) was collected from the seamless steel pipe at a ¼-thickness (thickness t in mm) location from the inner side of the pipe. Here, the test piece was collected in such an orientation that the pipe axis was in the tensile direction.

A sulfide stress corrosion cracking test according to the test method specified in NACE TM0177, Method A was conducted using the tensile test piece. The sulfide stress corrosion cracking test is a constant load test in which the tensile test piece is dipped in a test solution (a 5.0 mass % salt-containing aqueous solution of acetic acid and sodium acetate saturated with 10 kPa hydrogen sulfide and having an adjusted pH of 3.5; liquid temperature: 24° C.), and maintained under an applied stress equal to 90% of the yield stress YS obtained in the tensile test. The test piece was evaluated as having desirable sulfide stress corrosion cracking resistance when it did not break after 720 hours. The sulfide stress corrosion cracking test was not conducted on a test piece when the test piece was not possible to reach the target yield stress. In accordance with aspects of the present invention, the sulfide stress corrosion cracking test was conducted under more severe condition where the applied stress is largest than those described in the patent documents of the related art above. Accordingly, the sulfide stress corrosion cracking test was also conducted under the ordinary stress applied in the foregoing patent documents, specifically an applied stress equal to 85% of the yield stress YS obtained in the tensile test, others being under the same conditions described above.

The results are presented in Table 3.

TABLE 1

| Steel | Chemical components (mass %) | | | | | | | | | | | | | | | | |
|---|---|---|---|---|---|---|---|---|---|---|---|---|---|---|---|---|---|
| No. | C | Si | Mn | P | S | Al | N | Cr | Mo | V | Nb | B | Ti | Cu, Ni, W | Ca | O | Remarks |
| A | 0.31 | 0.15 | 0.55 | 0.005 | 0.0013 | 0.053 | 0.0016 | 1.53 | 1.10 | 0.120 | 0.009 | 0.0015 | 0.002 | — | — | 0.0015 | Example |
| B | 0.27 | 0.26 | 0.66 | 0.009 | 0.0015 | 0.066 | 0.0032 | 0.88 | 1.25 | 0.150 | 0.008 | 0.0031 | 0.002 | Ni:0.12 | — | 0.0009 | Example |
| C | 0.32 | 0.36 | 0.33 | 0.012 | 0.0007 | 0.075 | 0.0044 | 1.16 | 2.15 | 0.046 | 0.010 | 0.0038 | 0.001 | — | 0.0023 | 0.0008 | Example |
| D | 0.29 | 0.22 | 0.44 | 0.010 | 0.0009 | 0.035 | 0.0022 | 0.98 | 1.47 | 0.089 | 0.006 | 0.0040 | 0.001 | Cu:0.80 | — | 0.0011 | Example |
| E | 0.29 | 0.25 | 0.56 | 0.006 | 0.0010 | 0.065 | 0.0031 | 0.66 | 1.22 | 0.092 | 0.012 | 0.0028 | 0.002 | — | — | 0.0009 | Example |
| F | 0.27 | 0.30 | 0.52 | 0.011 | 0.0012 | 0.081 | 0.0048 | 0.75 | 1.17 | 0.214 | 0.015 | 0.0033 | 0.002 | Cu:0.45, Ni:0.23 | — | 0.0009 | Example |
| G | 0.28 | 0.24 | 0.55 | 0.010 | 0.0008 | 0.065 | 0.0034 | 0.77 | 1.08 | 0.075 | 0.008 | 0.0029 | 0.002 | W:1.06 | — | 0.0012 | Example |
| H | 0.27 | 0.36 | 0.45 | 0.007 | 0.0012 | 0.088 | 0.0045 | 0.85 | 1.33 | 0.034 | 0.011 | 0.0023 | 0.001 | — | — | 0.0012 | Example |
| I | 0.19 | 0.30 | 0.83 | 0.008 | 0.0009 | 0.066 | 0.0032 | 1.13 | 1.35 | 0.074 | 0.009 | 0.0030 | 0.001 | — | — | 0.0011 | Comparative Example |
| J | 0.51 | 0.22 | 0.35 | 0.013 | 0.0012 | 0.049 | 0.0022 | 0.99 | 1.31 | 0.075 | 0.014 | 0.0025 | 0.002 | — | — | 0.0009 | Comparative Example |
| K | 0.26 | 0.23 | 0.45 | 0.008 | 0.0015 | 0.048 | 0.0036 | 1.33 | 0.90 | 0.054 | 0.005 | 0.0022 | 0.002 | — | — | 0.0009 | Comparative Example |
| L | 0.30 | 0.25 | 0.45 | 0.011 | 0.0011 | 0.055 | 0.0042 | 0.55 | 1.75 | 0.055 | 0.004 | 0.0032 | 0.002 | — | — | 0.0014 | Comparative Example |
| M | 0.31 | 0.23 | 0.56 | 0.012 | 0.0010 | 0.055 | 0.0038 | 1.32 | 1.82 | 0.045 | 0.027 | 0.0025 | 0.001 | — | — | 0.0008 | Comparative Example |
| N | 0.31 | 0.24 | 0.70 | 0.011 | 0.0008 | 0.065 | 0.0066 | 1.25 | 1.65 | 0.038 | 0.007 | 0.0011 | 0.001 | — | — | 0.0018 | Comparative Example |
| O | 0.30 | 0.28 | 0.72 | 0.010 | 0.0009 | 0.063 | 0.0035 | 0.87 | 1.14 | 0.092 | 0.012 | 0.0025 | 0.002 | — | — | 0.0036 | Comparative Example |

TABLE 1-continued

| Steel | Chemical components (mass %) | | | | | | | | | | | | | | | | |
|---|---|---|---|---|---|---|---|---|---|---|---|---|---|---|---|---|---|
| No. | C | Si | Mn | P | S | Al | N | Cr | Mo | V | Nb | B | Ti | Cu, Ni, W | Ca | O | Remarks |
| P | 0.28 | 0.31 | 0.54 | 0.008 | 0.0009 | 0.065 | 0.0054 | 1.34 | 1.62 | 0.050 | 0.008 | 0.0015 | 0.005 | — | — | 0.0015 | Comparative Example |
| Q | 0.27 | 0.22 | 0.75 | 0.013 | 0.0011 | 0.073 | 0.0033 | 0.98 | 1.31 | 0.025 | 0.015 | 0.0033 | 0.022 | — | — | 0.0011 | Comparative Example |
| R | 0.36 | 0.20 | 0.45 | 0.012 | 0.0016 | 0.024 | 0.0012 | 1.35 | 1.24 | 0.095 | 0.015 | 0.0022 | 0.002 | — | — | 0.0014 | Comparative Example |
| S | 0.35 | 0.19 | 0.43 | 0.008 | 0.0021 | 0.021 | 0.0035 | 1.34 | 1.08 | 0.099 | 0.015 | 0.0020 | 0.009 | — | — | 0.0015 | Comparative Example |

*The balance is Fe and unavoidable impurities

The underlined is out of the range according to the invention

TABLE 2

| Steel pipe No. | Steel No. | Refining Process time (min)***** LF | Refining Process time (min)***** RH | Casting Sealing ****** | Casting Electro-magnetic stirring ******* | Heating Heating temperature (° C.) | Pipe dimensions Outer diameter (mmϕ) | Pipe dimensions Wall thickness (mm) | Cooling after hot working Cooling | Cooling after hot working Cooling stop temperature *(° C.) | Quenching Quenching temperature **(° C.) | Quenching Cooling stop temperature ***(° C.) | Tempering Tempering temperature (° C.) | $Ac_3$ transformation point (° C.) | Remarks |
|---|---|---|---|---|---|---|---|---|---|---|---|---|---|---|---|
| 1 | A | 50 | 20 | ○ | ○ | 1200 | 160 | 19 | Air cooling | ≤100 | 900 | 150 | 690 | 852 | Example |
| 2 | A | 50 | 20 | ○ | ○ | 1230 | 200 | 25 | Air cooling | ≤100 | 900<br>890**** | 150<br>150**** | 690 | 852 | Example |
| 3 | B | 60 | 30 | ○ | ○ | 1230 | 160 | 19 | Air cooling | ≤100 | 930 | 150 | 705 | 892 | Example |
| 4 | B | 60 | 30 | ○ | ○ | 1230 | 100 | 12 | Air cooling | ≤100 | 930 | <100 | 705 | 892 | Example |
| 5 | B | 60 | 30 | ○ | ○ | 1230 | 160 | 19 | Water cooling | 200 | — | — | 690 | 892 | Example |
| 6 | B | 60 | 30 | ○ | ○ | 1230 | 160 | 19 | Water cooling | 200 | 930 | 150 | 690 | 892 | Example |
| 7 | B | 60 | 30 | ○ | ○ | 1230 | 200 | 25 | Air cooling | ≤100 | 930 | <100 | 700 | 892 | Example |
| 8 | C | 45 | 40 | ○ | ○ | 1230 | 160 | 19 | Air cooling | ≤100 | 930 | <100 | 710 | 908 | Example |
| 9 | D | 50 | 40 | ○ | ○ | 1230 | 160 | 19 | Air cooling | ≤100 | 930 | <100 | 700 | 872 | Example |
| 10 | E | 50 | 30 | ○ | ○ | 1230 | 230 | 25 | Air cooling | ≤100 | 930 | 150 | 700 | 879 | Example |
| 11 | F | 50 | 30 | ○ | ○ | 1260 | 160 | 19 | Air cooling | ≤100 | 930 | <100 | 720 | 896 | Example |
| 12 | G | 60 | 30 | ○ | ○ | 1230 | 160 | 19 | Air cooling | ≤100 | 930 | <100 | 690 | 876 | Example |
| 13 | I | 30 | 30 | ○ | ○ | 1230 | .160 | 19 | Air cooling | ≤100 | 940 | <100 | 690 | 925 | Comparative Example |
| 14 | J | 40 | 30 | ○ | ○ | 1230 | 160 | 19 | Air cooling | ≤100 | 900 | <100 | 690 | 772 | Comparative Example |
| 15 | K | 40 | 30 | ○ | ○ | 1230 | 160 | 19 | Air cooling | ≤100 | 900 | <100 | 690 | 869 | Comparative Example |
| 16 | L | 50 | 10 | ○ | ○ | 1230 | 160 | 19 | Air cooling | ≤100 | 930 | <100 | 705 | 892 | Comparative Example |
| 17 | M | 40 | 30 | ○ | ○ | 1230 | 160 | 19 | Air cooling | ≤100 | 930 | <100 | 705 | 878 | Comparative Example |
| 18 | N | 40 | 30 | ○ | ○ | 1230 | 160 | 19 | Air cooling | ≤100 | 900 | <100 | 690 | 867 | Comparative Example |
| 19 | O | 30 | 10 | ○ | × | 1230 | 160 | 19 | Air cooling | ≤100 | 900 | <100 | 690 | 867 | Comparative Example |

TABLE 2-continued

| Steel pipe No. | Steel No. | Refining Process time (min)***** LF | Refining Process time (min)***** RH | Casting Sealing ****** | Casting Electro-magnetic stirring ******* | Heating Heating temperature (° C.) | Pipe dimensions Outer diameter (mmϕ) | Pipe dimensions Wall thickness (mm) | Cooling after hot working Cooling | Cooling after hot working Cooling stop temperature *(° C.) | Quenching Quenching temperature **(° C.) | Quenching Cooling stop temperature ***(° C.) | Tempering Tempering temperature (° C.) | $Ac_3$ transformation point (° C.) | Remarks |
|---|---|---|---|---|---|---|---|---|---|---|---|---|---|---|---|
| 20 | P | 30 | 10 | ○ | ○ | 1230 | 160 | 19 | Air cooling | ≤100 | 930 | <100 | 690 | 890 | Comparative Example |
| 21 | Q | 50 | 30 | ○ | ○ | 1250 | 160 | 19 | Air cooling | ≤100 | 930 | <100 | 680 | 882 | Comparative Example |
| 22 | F | 50 | 30 | ○ | ○ | 1230 | 160 | 19 | Air cooling | ≤100 | 930 | <100 | 760 | 896 | Comparative Example |
| 23 | F | 50 | 30 | ○ | ○ | 1230 | 160 | 19 | Air cooling | ≤100 | 930 | 335 | 670 | 896 | Comparative Example |
| 24 | H | 20 | 15 | × | × | 1230 | 230 | 25 | Air cooling | ≤100 | 930 | 150 | 700 | 895 | Comparative Example |
| 25 | R | 60 | 30 | ○ | ○ | 1250 | 230 | 19 | Air cooling | ≤100 | 900 | <100 | 640 | 898 | Comparative Example |
| 26 | S | 60 | 30 | ○ | ○ | 1250 | 273 | 32 | Air cooling | ≤100 | 900 | <100 | 690 | 891 | Comparative Example |

*Cooling stop temperature: Surface temperature
**Reheating temperature
***Cooling stop temperature for quenching: Surface temperature
****Second quenching
*****LF: Stirred refining under heat, RH: vacuum degassing
****** Sealing for teaming from ladle to tundish: Present: ○, Absent: ×
******* Electromagnetic stirring inside mold Present: ○, Absent: ×
The underlined is out of the range according to the invention

TABLE 3

| Steel pipe No. | Steel No. | Structure: Number density of nitride inclusions * Less than 4 μm | Structure: Number density of nitride inclusions * 4 μm or More | Structure: Number density of oxide inclusions * Less than 4 μm | Structure: Number density of oxide inclusions * 4 μm or More | Structure: Number density of carbides 175 nm or more *** | Structure: TM structure Type** | Structure: TM structure fraction (volume %) | Tensile characteristics Yield strength YS (MPa) | Tensile characteristics Tensile strength TS (MPa) | SSC resistance 85% Stress relative to YS | SSC resistance 90% Stress relative to YS | Remarks |
|---|---|---|---|---|---|---|---|---|---|---|---|---|---|
| 1 | A | 242 | 10 | 310 | 31 | 45 | TM + B | 95 | 888 | 973 | ○ | ○ | Example |
| 2 | A | 265 | 14 | 332 | 29 | 58 | TM + B | 95 | 910 | 981 | ○ | ○ | Example |
| 3 | B | 443 | 36 | 214 | 13 | 47 | TM + B | 95 | 875 | 972 | ○ | ○ | Example |
| 4 | B | 442 | 34 | 200 | 13 | 39 | TM + B | 95 | 881 | 943 | ○ | ○ | Example |
| 5 | B | 425 | 39 | 195 | 14 | 42 | TM + B | 95 | 928 | 1008 | ○ | ○ | Example |
| 6 | B | 432 | 40 | 204 | 20 | 40 | TM + B | 98 | 887 | 956 | ○ | ○ | Example |
| 7 | B | 433 | 36 | 192 | 18 | 45 | TM + B | 95 | 891 | 984 | ○ | ○ | Example |
| 8 | C | 392 | 37 | 184 | 15 | 86 | TM + B | 92 | 920 | 1002 | ○ | ○ | Example |
| 9 | D | 443 | 42 | 223 | 26 | 70 | TM + B | 95 | 913 | 982 | ○ | ○ | Example |
| 10 | E | 339 | 12 | 226 | 20 | 42 | TM + B | 95 | 934 | 998 | ○ | ○ | Example |
| 11 | F | 248 | 26 | 221 | 25 | 56 | TM + B | 95 | 940 | 1015 | ○ | ○ | Example |
| 12 | G | 293 | 34 | 339 | 24 | 35 | TM + B | 95 | 923 | 1002 | ○ | ○ | Example |
| 13 | I | 195 | 26 | 275 | 13 | 63 | TM + B | 95 | 817 | 901 | — | — | Comparative Example |
| 14 | J | 325 | 24 | 277 | 17 | 78 | TM + B | 95 | 899 | 975 | × | × | Comparative Example |
| 15 | K | 380 | 16 | 283 | 22 | 80 | TM + B | 95 | 906 | 1004 | × | × | Comparative Example |
| 16 | L | 429 | 35 | 244 | 84 | 60 | TM + B | 95 | 941 | 1013 | × | × | Comparative Example |

TABLE 3-continued

| Steel pipe No. | Steel No. | Structure: Number density of nitride inclusions * Less than 4 μm | Number density of nitride inclusions * 4 μm or More | Number density of oxide inclusions * Less than 4 μm | Number density of oxide inclusions * 4 μm or More | Number density of carbides 175 nm or more *** | TM structure Type** | TM structure fraction (volume %) | Tensile characteristics Yield strength YS (MPa) | Tensile characteristics Tensile strength TS (MPa) | SSC resistance 85% Stress relative to YS | SSC resistance 90% Stress relative to YS | Remarks |
|---|---|---|---|---|---|---|---|---|---|---|---|---|---|
| 17 | M | 461 | 89 | 175 | 17 | 57 | TM + B | 95 | 876 | 988 | × | × | Comparative Example |
| 18 | N | 305 | 65 | 345 | 32 | 53 | TM + B | 95 | 886 | 992 | × | × | Comparative Example |
| 19 | O | 430 | 13 | 622 | 35 | 55 | TM + B | 95 | 863 | 934 | × | × | Comparative Example |
| 20 | P | 896 | 39 | 330 | 28 | 55 | TM + B | 95 | 887 | 987 | ○ | × | Comparative Example |
| 21 | Q | 1125 | 122 | 346 | 21 | 45 | TM + B | 95 | 928 | 1020 | × | × | Comparative Example |
| 22 | F | 236 | 24 | 250 | 29 | 51 | TM + B | 95 | 833 | 903 | — | — | Comparative Example |
| 23 | F | 320 | 30 | 243 | 22 | 40 | TM + B | 80 | 814 | 902 | — | — | Comparative Example |
| 24 | H | 612 | 107 | 423 | 166 | 25 | TM + B | 95 | 925 | 1011 | × | × | Comparative Example |
| 25 | R | 205 | 25 | 128 | 20 | 123 | TM + B | 90 | 931 | 1008 | ○ | × | Comparative Example |
| 26 | S | 470 | 46 | 115 | 18 | 112 | TM + B | 95 | 936 | 1015 | ○ | × | Comparative Example |

* Number density: Number/100 $mm^2$
**TM: Tempered martensite, B: bainite
*** Number density: Number/100 $\mu m^2$
The underlined is out of the range according to the invention The seamless steel pipes of the Examples all had high strength with a yield stress YS of 862 MPa or more, and excellent SSC resistance. Comparative Examples outside the range of the present invention had lower yield stress YS, and the desired high strength was not obtained, or the SSC resistance was deteriorated.

Steel pipe No. 13 (steel No. I) with a carbon content lower than the range of the present invention did not show the desired high strength. Steel pipe No. 14 (steel No. J) with a carbon content higher than the range of the present invention had poor SSC resistance in the tempering temperature range of the present invention. Steel pipe No. 15 (steel No. K) with a Mo content lower than the range of the present invention showed the desired high strength, but the deteriorated SSC resistance.

In steel pipe No. 16 (steel No. L) that had a Cr content lower than the range of the present invention, and the number of inclusions outside the range of the present invention, the desired high strength was obtained, but the SSC resistance was deteriorated. Steel pipe No. 17 (steel No. M) that had a Nb content higher than the range of the present invention, and the number of inclusions outside the range of the present invention showed the desired high strength, but the deteriorated SSC resistance was deteriorated. In steel pipe No. 18 (steel No. N) that had a N content higher than the range of the present invention, and the number of inclusions (nitride inclusions) outside the range of the present invention, the desired high strength was obtained, but the SSC resistance was deteriorated.

Steel pipe No. 19 (steel No. O) that had an O content higher than the range of the present invention, and the number of inclusions (oxide inclusions) outside the range of the present invention showed the desired high strength, but the SSC resistance was deteriorated. In steel pipe No. 20 (steel No. P) and No. 21 (steel No. Q), in which the Ti content was higher than the range of the present invention, and the number of inclusions (nitride inclusions) was outside the range of the present invention, the desired high strength was obtained, but the SSC resistance was deteriorated.

In steel pipe No. 22 (steel No. F) that contained the components within the range of the present invention, but for which tempering was performed with a temperature higher than the range of the present invention, strength was low. In steel pipe No. 23 (steel No. F) for which quenching was performed with a cooling stop temperature higher than the range of the present invention, the desired structure with a primary martensite phase was not obtained, and the strength was low. In steel pipe No. 24 (steel No. H) that contained the components within the range of the present invention, but in which the number of inclusions (nitride inclusions and oxide inclusions) was outside the range of the present invention, the SSC resistance was deteriorated.

In steel pipe No. 25 (steel No. R) and No. 26 (steel No. S) with Al contents lower than the range of the invention, the number of coarse carbides with a corresponding circle diameter of 175 nm or more exceeded the range of the invention, and the SSC resistance was deteriorated.

The invention claimed is:

1. A high-strength seamless steel pipe for oil country tubular goods, the high-strength seamless steel pipe having a composition that comprises, in mass %, C: 0.20 to 0.35%, Si: 0.05 to 0.40%, Mn: 0.3 to 0.9%, P: 0.015% or less, S: 0.005% or less, Al: 0.03 to 0.1%, N: 0.006% or less, Cr: more than 0.6% and 1.7% or less, Mo: more than 1.0% and 3.0% or less, V: 0.02 to 0.3%, Nb: 0.001 to 0.02%, B: 0.0005 to 0.0040%, O (oxygen): 0.0030% or less, Ti: less than 0.003%, and the balance being Fe and unavoidable impurities, the high-strength seamless steel pipe having a structure in which the volume fraction of tempered martensite is 90% or more, and in which the number of nitride inclusions with a particle diameter of 4 μm or more is 50 or less per 100 $mm^2$, the number of nitride inclusions with a particle diameter of less than 4 μm is 500 or less per 100 $mm^2$, the number of oxide inclusions with a particle diameter of 4 μm or more is 40 or less per 100 $mm^2$, and the number of oxide inclusions with a particle diameter of less than 4 μm is 400 or less per 100 $mm^2$ in a cross section perpendicular to a rolling direction, the high-strength seamless steel pipe having a yield stress YS of 862 MPa or more, wherein the structure contains at most 100 carbides having a corresponding circle diameter of 175 nm or more per 100 $\mu m^2$ in a cross section perpendicular to the rolling direction.

2. The high-strength seamless steel pipe for oil country tubular goods according to claim 1, wherein the composition further contains, in mass %, at least one element selected from at least one of groups A and B, Group A: one or more elements selected from Cu: 1.0% or less, Ni: 1.0% or less, and W: 3.0% or less, Group B: Ca: 0.0005 to 0.005%.

3. A method for producing a seamless steel pipe for oil country tubular goods by heating a steel pipe material, and hot working the steel pipe material into a seamless steel pipe of a predetermined shape, wherein the method is for producing the high-strength seamless steel pipe for oil country tubular goods of claim 1, and comprises:

heating the steel pipe material in a heating temperature range of 1,050 to 1,350° C.;

cooling the hot-worked seamless steel pipe to a surface temperature of 200° C. or less at a cooling rate of air cooling or faster; and tempering the seamless steel pipe by heating to a temperature of 640 to 740° C.

4. The method according to claim 3, wherein the seamless steel pipe after the cooling and before the tempering is quenched at least once by being reheated to a temperature equal to or greater than the $Ac_3$ transformation point and 1,000° C. or less, and rapidly cooled to a surface temperature of 200° C. or less.

5. A method for producing a seamless steel pipe for oil country tubular goods by heating a steel pipe material, and hot working the steel pipe material into a seamless steel pipe of a predetermined shape, wherein the method is for producing the high-strength seamless steel pipe for oil country tubular goods of claim 2, and comprises:

heating the steel pipe material in a heating temperature range of 1,050 to 1,350° C.;

cooling the hot-worked seamless steel pipe to a surface temperature of 200° C. or less at a cooling rate of air cooling or faster; and tempering the seamless steel pipe by heating to a temperature of 640 to 740° C.

6. The method according to claim 5, wherein the seamless steel pipe after the cooling and before the tempering is quenched at least once by being reheated to a temperature equal to or greater than the $Ac_3$ transformation point and 1,000° C. or less, and rapidly cooled to a surface temperature of 200° C. or less.

* * * * *